US010030644B2

(12) United States Patent
Osborne

(10) Patent No.: US 10,030,644 B2
(45) Date of Patent: Jul. 24, 2018

(54) FLOW ROUTER WITH RETRIEVABLE VALVE ASSEMBLY

(71) Applicant: Lawrence Osborne, Acton, CA (US)

(72) Inventor: Lawrence Osborne, Acton, CA (US)

( * ) Notice: Subject to any disclaimer, the term of this patent is extended or adjusted under 35 U.S.C. 154(b) by 270 days.

(21) Appl. No.: 14/702,085

(22) Filed: May 1, 2015

(65) Prior Publication Data

US 2015/0233207 A1 Aug. 20, 2015

Related U.S. Application Data

(63) Continuation-in-part of application No. 13/446,195, filed on Apr. 13, 2012, now Pat. No. 9,562,418, which is a continuation-in-part of application No. 13/089,312, filed on Apr. 19, 2011, now Pat. No. 8,955,601, which is a continuation-in-part of application No. 12/766,141, filed on Apr. 23, 2010, now Pat. No. 8,545,190.

(60) Provisional application No. 61/611,543, filed on Mar. 15, 2012.

(51) Int. Cl.

| | |
|---|---|
| ***F04B 47/00*** | (2006.01) |
| ***E21B 43/12*** | (2006.01) |
| *E21B 34/00* | (2006.01) |

(52) U.S. Cl.

CPC ..... *F04B 47/00* (2013.01); *E21B 43/128* (2013.01); *E21B 2034/005* (2013.01)

(58) Field of Classification Search

CPC .. F16K 17/0473; F16K 17/0446; E21B 21/10; E21B 21/103

See application file for complete search history.

(56) References Cited

U.S. PATENT DOCUMENTS

| | | | |
|---|---|---|---|
| 1,091,463 | A | 3/1914 | Vincent |
| 2,256,704 | A | 9/1941 | Crickmer et al. |
| 2,575,677 | A | 11/1951 | Neu |
| 2,669,248 | A | 2/1954 | Miller |
| 3,027,907 | A | 4/1962 | Lee |
| 3,498,056 | A | 3/1970 | Avery |
| 3,713,703 | A | 1/1973 | Brown |
| 3,818,929 | A | 6/1974 | Braukmann |
| 3,905,382 | A | 9/1975 | Waterston |
| 3,952,766 | A | 4/1976 | Johnson |
| 4,057,074 | A | 11/1977 | Fischer |
| 4,519,574 | A | 5/1985 | Roper |
| 4,880,060 | A | 11/1989 | Schwendemann et al. |
| 5,305,777 | A | 4/1994 | Nakamura et al. |
| 5,439,022 | A | 8/1995 | Summers et al. |
| 5,571,002 | A | 11/1996 | Kokoi |
| 5,873,414 | A | 2/1999 | von Gynz-Rekowski |

(Continued)

FOREIGN PATENT DOCUMENTS

CN 202612126 U 12/2012

*Primary Examiner* — Kenneth J Hansen

(74) *Attorney, Agent, or Firm* — Paul D. Chancellar; Ocean Law

(57) ABSTRACT

Embodiments of the present invention provide a flow router for inclusion in a production string that is for insertion in a well casing, the flow router comprising a retrievable assembly removably inserted in a perforated cover and a valve of the retrievable assembly including a valve body extending extends between opposed first and second ends of the valve to define an axial flow path, the retrievable assembly retrievable to and removable from an open end of the production string.

10 Claims, 11 Drawing Sheets

(56) References Cited

U.S. PATENT DOCUMENTS

| | | | | |
|---|---|---|---|---|
| 6,227,299 | B1 * | 5/2001 | Dennistoun | E21B 34/06 137/515 |
| 6,289,990 | B1 | 9/2001 | Dillon et al. | |
| 6,863,124 | B2 | 3/2005 | Araux et al. | |
| 6,868,772 | B2 | 3/2005 | Rice et al. | |
| 7,443,067 | B2 | 10/2008 | Schlosser | |
| 7,628,170 | B2 | 12/2009 | Kok-Hiong et al. | |
| 7,666,013 | B1 | 2/2010 | Kopecky et al. | |
| 7,927,083 | B2 | 4/2011 | Simmons | |
| 8,397,742 | B2 | 3/2013 | Thrash et al. | |
| 2002/0174988 | A1 * | 11/2002 | Szarka | E21B 21/103 166/325 |
| 2004/0107991 | A1 | 6/2004 | Hollister et al. | |
| 2007/0119599 | A1 | 5/2007 | Chavers et al. | |
| 2008/0041477 | A1 | 2/2008 | Shatter et al. | |
| 2009/0071643 | A1 * | 3/2009 | AlMubarak | E21B 34/08 166/135 |
| 2012/0070319 | A1 | 3/2012 | Pedrollo | |

* cited by examiner

FLOW ROUTER WITH RETRIEVABLE VALVE ASSEMBLY

PRIORITY CLAIM

This application is a continuation in part of U.S. patent application Ser. No. 13/446,195 filed Apr. 13, 2012, which a) claims the benefit of U.S. Prov. Pat. App. No. 61/611,453 filed Mar. 15, 2012 and b) is a continuation in part of U.S. patent application Ser. No. 13/089,312 filed Apr. 19, 2011 (now U.S. Pat. No. 8,955,601) which is a continuation in part of U.S. patent application Ser. No. 12/766,141 filed Apr. 23, 2010 (now U.S. Pat. No. 8,545,190). All of these applications are incorporated herein by reference, in their entireties and for all purposes.

BACKGROUND OF THE INVENTION

Field of the Invention

The present invention relates to fluid flow components and systems using those components. In particular, the present invention relates to a flow router with a retrievable assembly.

Discussion of the Related Art

Pumps and valves located in hard to reach places present maintenance and maintenance downtime issues. Where pumps and valves are used to produce a natural resource such as a hydrocarbon, downtime can result in lost production and increased expenses for workmen and materials.

In particular, downhole production strings including pumps and valves for lifting fluids such as particulate laden liquids and slurries present a maintenance problem. Here, both pumps and valves can lose capacity and in cases be rendered inoperative when conditions including fluid conditions and fluid velocities fall outside an intended operating range. Such unintended operating conditions can foul, plug, and damage equipment.

Despite the industry's hesitance to adopt new technology, there remains a need to improve production strings.

SUMMARY OF THE INVENTION

The present invention provides a flow router with a retrievable assembly. In an embodiment, a flow router is for inclusion in a production tubing string that is for insertion in a well casing, the flow router comprising: a retrievable assembly removably inserted in a perforated cover with a bypass flow annulus therebetween; a valve of the retrievable assembly including a valve body that extends between opposed first and second ends of the valve and defines an axial flowpath; a valve body spill port that defines a radial flowpath, the spill port in fluid communication with the bypass flow annulus via the cover perforation; a shuttle inserted in the valve body for selectively blocking the spill port; a lid rotatably affixed to a shuttle lid end, the lid for selectively blocking a shuttle through hole; the valve for passing an axial flow when (i) the shuttle blocks the spill port and (ii) the lid does not block the through hole; and, the valve for blocking an axial flow when (i) the lid blocks the shuttle through hole and (ii) the shuttle does not block the spill port; wherein the retrievable assembly is retrievable to and removable from an open end of the tubing string and wherein the retrievable assembly is insertable in the tubing string for insertion in the cover.

BRIEF DESCRIPTION OF THE DRAWINGS

The present invention is described with reference to the accompanying figures. These figures, incorporated herein and forming part of the specification, illustrate the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed invention.

To the extent parts, components and functions of the described invention exchange fluids, the associated interconnections and couplings may be direct or indirect unless explicitly described as being limited to one and/or the other. Notably, indirectly connected parts, components and functions may have interposed devices and/or functions known to persons of ordinary skill in the art.

Embodiments of the present invention relate to fluid flow components and systems using those components. In particular, embodiments of the present invention relate to a flow router with a retrievable assembly as may be used in fluid flow systems such as downhole hydrocarbon production strings.

Figure 1:
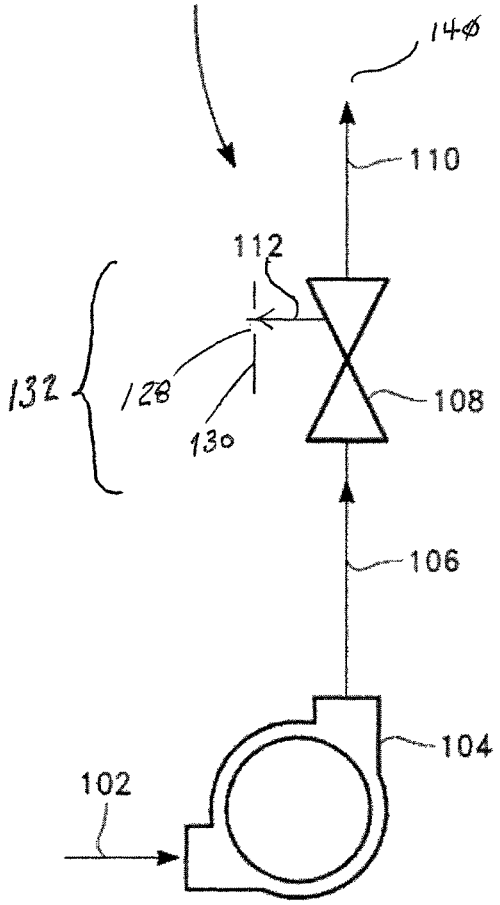
FIG. 1 shows a schematic diagram of a production string portion including a flow router.

FIG. 1 shows a schematic diagram of an embodiment of the invention 100. A bypass valve 108 is interconnected with a pump 104 via a pump outlet 106. The pump includes a pump inlet 102 and the valve includes a valve outlet 110 and a valve spill port 112. Flow from the spill port 112 passes through a perforation(s) 128 in a valve cover 130. As described here and below, the valve 108 is included in an assembly that is retrievable from the cover. Together, the retrievable assembly and cover may be referred to as a flow router 132. In some embodiments, the inlets, outlets and ports are or include one or more of a fitting, flange, pipe, tubing, or similar fluid conveyance part(s). In some embodiments, the pump 104 is a downhole pump in a hydrocarbon production string and downstream of the valve 108 is a production string head end 140.

Figure 2:
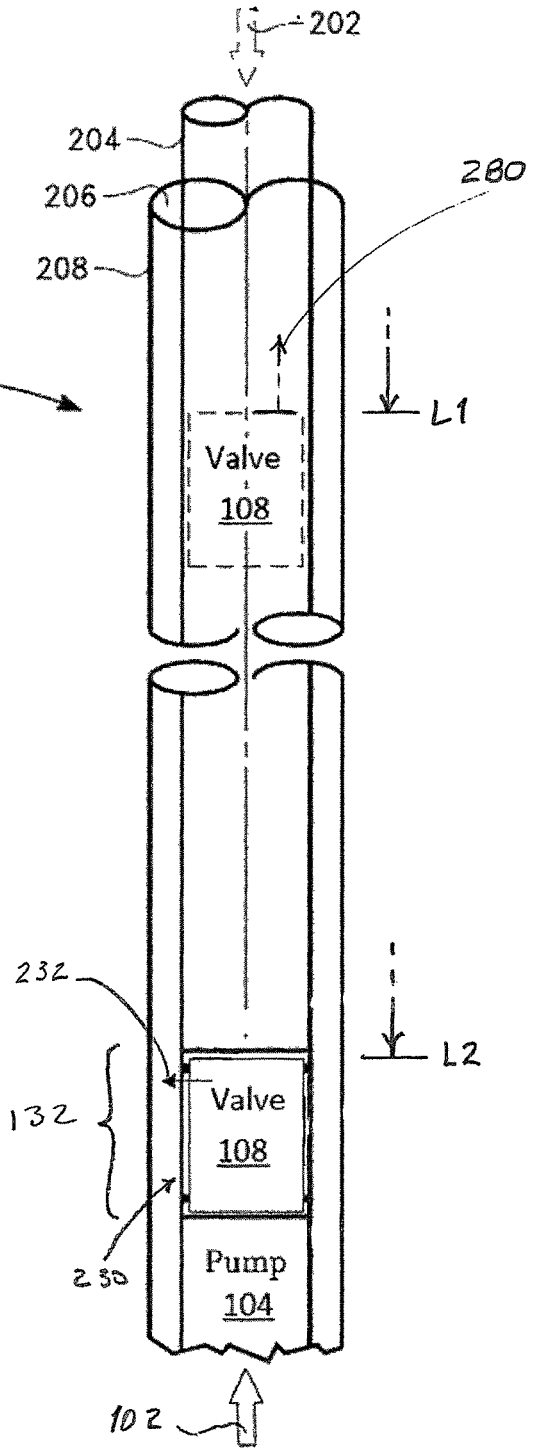
FIG. 2 shows a production string portion including the flow router of FIG. 1.

FIG. 2 shows portions of a downhole production string 200. The production string includes the bypass valve 108 within a perforated spool, cover, or cover assembly 230 that may be part of or distinct from production tubing. The valve is interposed between the pump 104 and a tubing string portion or an upper tubing string portion 204. In some embodiments, a surround or casing 208 surrounds one or more of the tubing string, valve, and pump. Here, an annulus such as an outer annulus 206 is formed between the tubing string and the casing. A production flow is indicated by an upwardly pointed arrow 102 while a backflow is indicated by a downwardly pointed arrow 202.

A bypass flow 232 may exit the valve and enter the outer annulus via the perforated cover 230 when there is a backflow 202. In some embodiments, the bypass valve serves to isolate backflows, for example to isolate backflows from one or more of the valve, portions of the valve, and/or the pump.

As indicated by the solid lines, the valve 108 may be fixed at level L2 adjacent to or near the pump 104 during normal operation of the string 200. And, as indicated by dashed lines, the valve 108 may be suspended from a line 280 at level L1 during either of a valve removal or valve installation. Lines include any means known to skilled artisans for manipulating downhole appliances, for example wirelines and related tools/services that may be provided by vendors such as Schlumberger®.

Figure 3:
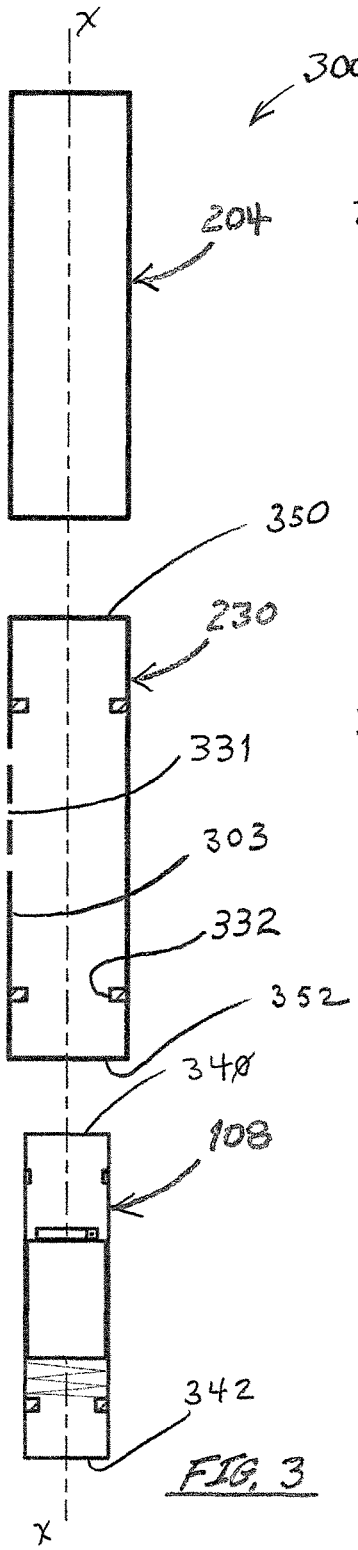
FIGS. 3-6 show a first embodiment of the flow router of FIG. 1.

FIG. 3 shows an exploded view of portions of the production string 300. In particular, a tubing string 204 is for mating with a perforated valve cover 230 such that when the valve 108 is inserted in the valve cover a flowpath along a common longitudinal axis x-x is established.

As shown, the perforated valve cover 230 has a first end 350 and a second end 352 and a sidewall 303 extending therebetween. One or multiple sidewall penetrations 331 (multiple shown) provide a flowpath across the cover sidewall. In some embodiments, the valve cover is assembled from multiple parts.

As shown, the valve 108 has a spring end 342 and an end opposite the spring end 340. In various embodiments, the valve or the valve cover includes integral or attachable means for sealing between the valve and the valve cover. For example, valve cover internal sealing means 332 as shown.

Figure 4:
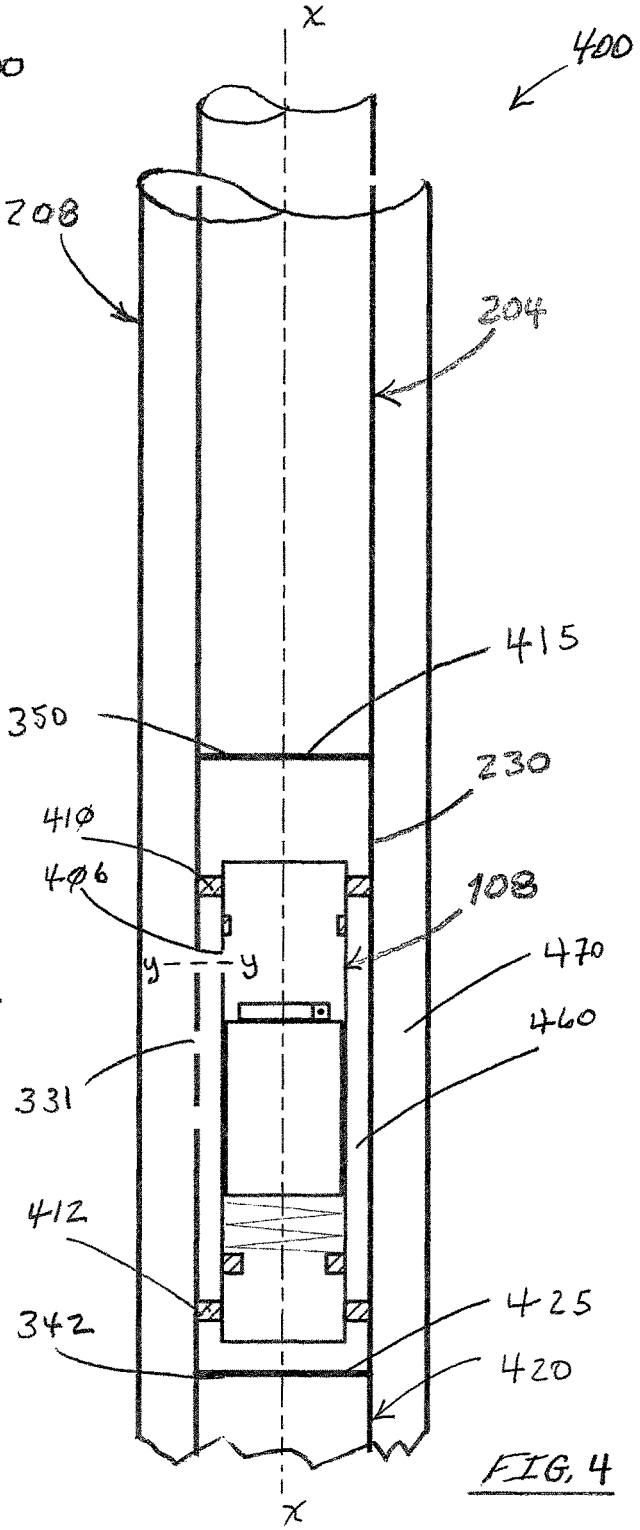

FIG. 4 shows a view of portions of the production string 400. As shown, the valve 108 is inserted in the valve cover 230 and the tubing string 204 mates 415 with the valve cover at the valve cover first end 350. This assemblage of parts 204, 230, 108 is at least partially inserted in the casing 208.

The valve cover or valve mates with a pump outlet or conduit. For example, the valve cover 230 may mate 425 with a conduit 420 that interconnects with a pump 108 to receive a pump outlet flow 102.

In various embodiments, spaced apart sealing means 410, 412 located between the valve 108 and the valve cover 230 define a first annular chamber or space 460. This first annular chamber may fluidly communicate with a second annular chamber or space 470 between the valve cover and the casing 208, for example along an axis y-y via a valve port such as a valve side port 406 and a cover penetration 331.

Figure 5:
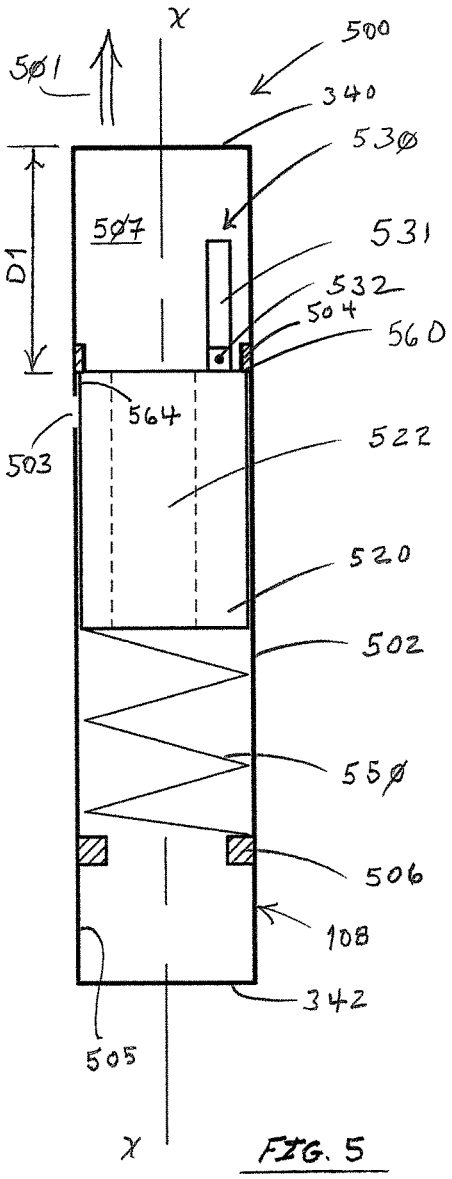
Figure 6:
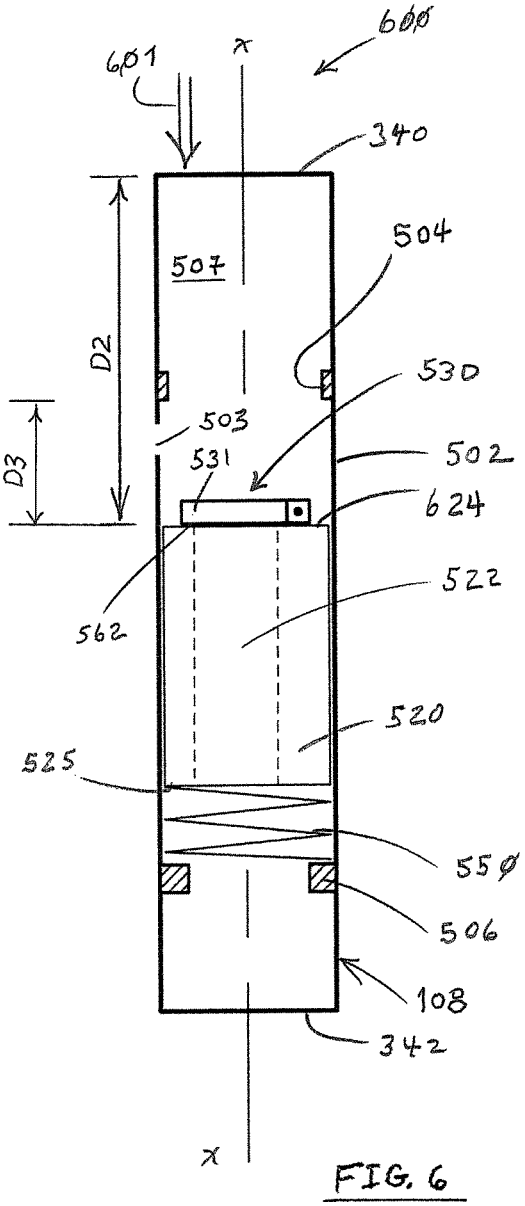

FIG. 5-6 show valve configurations 500, 600. In FIG. 5, the valve is configured for forward flow 501. In FIG. 6, the valve is configured for reverse flow 601. As shown, a forward flow 501 exits the valve first end 340 while a reverse flow 601 enters the valve first end 340.

The valve includes a valve body 502, a lid carrier or shuttle 520, and a shuttle biasing means such as a spring or coil spring 550. The valve body 502 is tubular with a sidewall 502 that extends between first 340 and second 342 valve ends. A port such as a sidewall port 503 is located in the valve body sidewall 502. The port provides a flow path to a valve interior such as a chamber 507 above the valve shuttle 520.

The shuttle 520 is inserted in the valve body 502 and is biased to engage an inward projection or nose 504 near the valve first end 340. In various embodiments, the nose is integral with or supported by the valve body and in various embodiments abutment of the shuttle and the nose provides a first seal 560.

Shuttle biasing may be provided by a shuttle spring 550 that extends between a lower shuttle end 525 and a spring support such as an annular ring 506 that is integral with or supported by the valve body near the valve second end 342. As seen, when the shuttle is in position D1, the shuttle blocks the sidewall port 503, for example via a second seal 564.

The shuttle 520 includes a shuttle through hole 522 for passing a forward flow 501 and a means for blocking the through hole when there is a reverse flow 601. In an embodiment, the through hole blocking means is provided by a lid assembly 530 including an articulated lid 531 that is rotatably mounted to a shuttle upper end 624 as by a hinge 532.

Means for closing the lid 531 against the shuttle 520 to block the through hole 522 via a third seal 562 may be provided by mechanical, gravitational, and/or fluid dynamic means. For example, the lid may be spring biased as by a leaf or coil spring integral with the hinge or not. And, for example, the lid may be configured and/or shaped for actuation by fluid dynamic and/or gravitational forces.

Referring to the forward flow 501 configuration of FIG. 5, in position D1, the shuttle is up, the lid 531 does not block the shuttle through hole 522, and the spill port 503 is closed. Referring to the reverse flow 601 configuration of FIG. 6, in position D2, the shuttle is down, the lid blocks the shuttle through hole, and the spill port is open.

Notably, the shuttle 520 moves in the valve body 502 in response to forces acting on the shuttle. For example, in a forward flow state with the shuttle in position D1, pump 104 fluid forces exerted on the shuttle together with a spring 550 force exerted on the shuttle exceed the fluid force exerted on the shuttle by fluid in the tubing string 204 above the shuttle. And, for example, in a reverse flow state with the shuttle in position D2 (where D2−D1=D3), the fluid force exerted by the fluid in the tubing string above the shuttle exceeds the pump and spring forces.

In an embodiment, a shuttle 520 transition from (i) D1 and a forward flow state to (ii) D2 and a reverse flow state occurs when the articulated lid 531 moves to block the shuttle through hole 522 such that fluid head in the tubing string 204 above the shuttle 520 acts on the blocked shuttle, compresses the spring 550, and opens the spill port 503.

And, in an embodiment, a shuttle transition from (i) D2 and a reverse flow state to (ii) D1 and a forward flow state includes moving the lid 531 to unblock the shuttle through hole 522. Here, fluid head in the tubing string 204 is no longer adequate to overcome spring 550 and pump 104 forces such that the shuttle moves toward the body first end 340, decompresses the spring 550, and closes the spill port 503. Typical of this transition from reverse flow to forward flow is the start or resumption of proper pump operation.

Figure 7A:
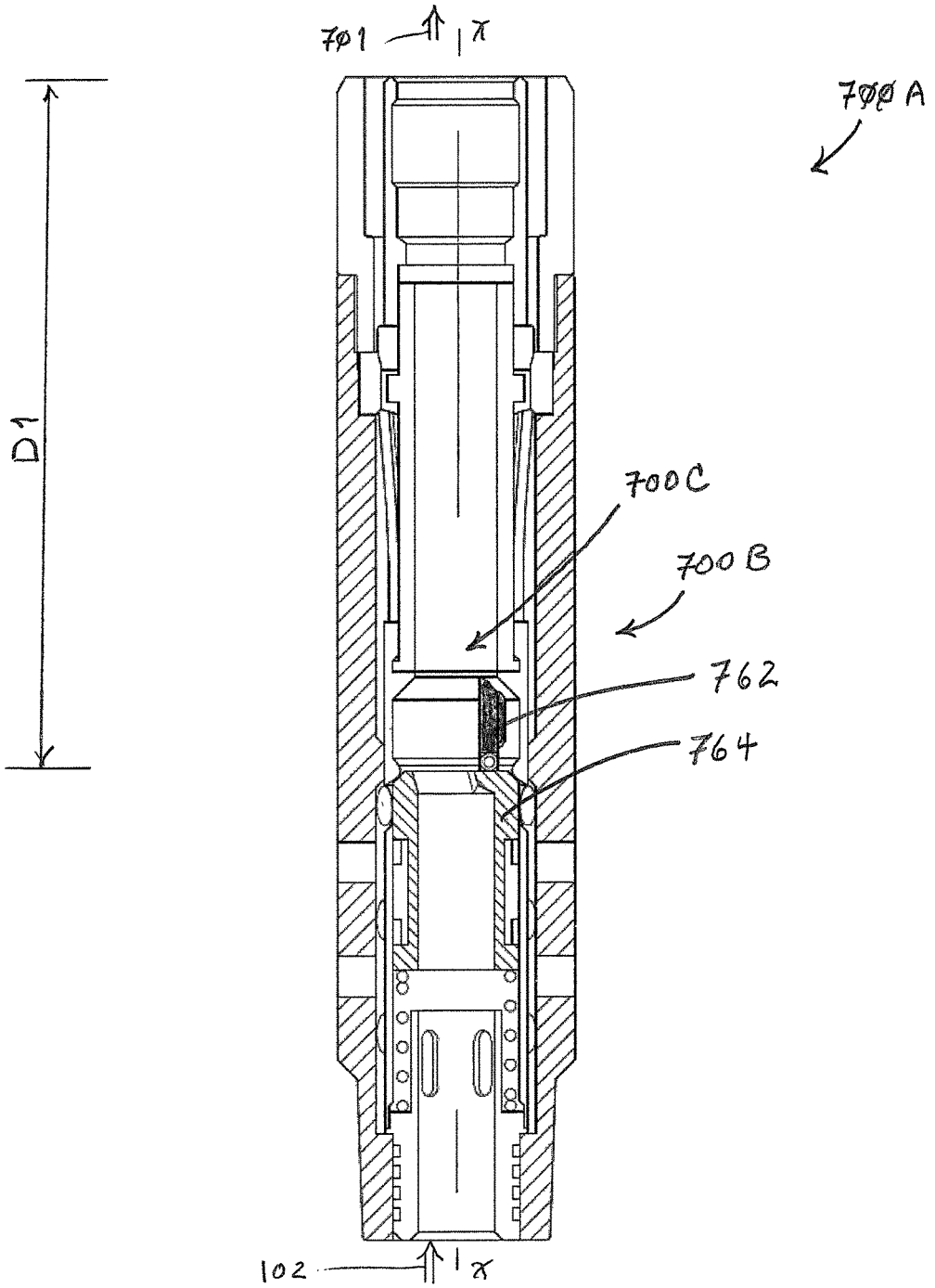
FIGS. 7A-C and FIG. 8 show a second embodiment of the flow router of FIG. 1.
Figure 7B:
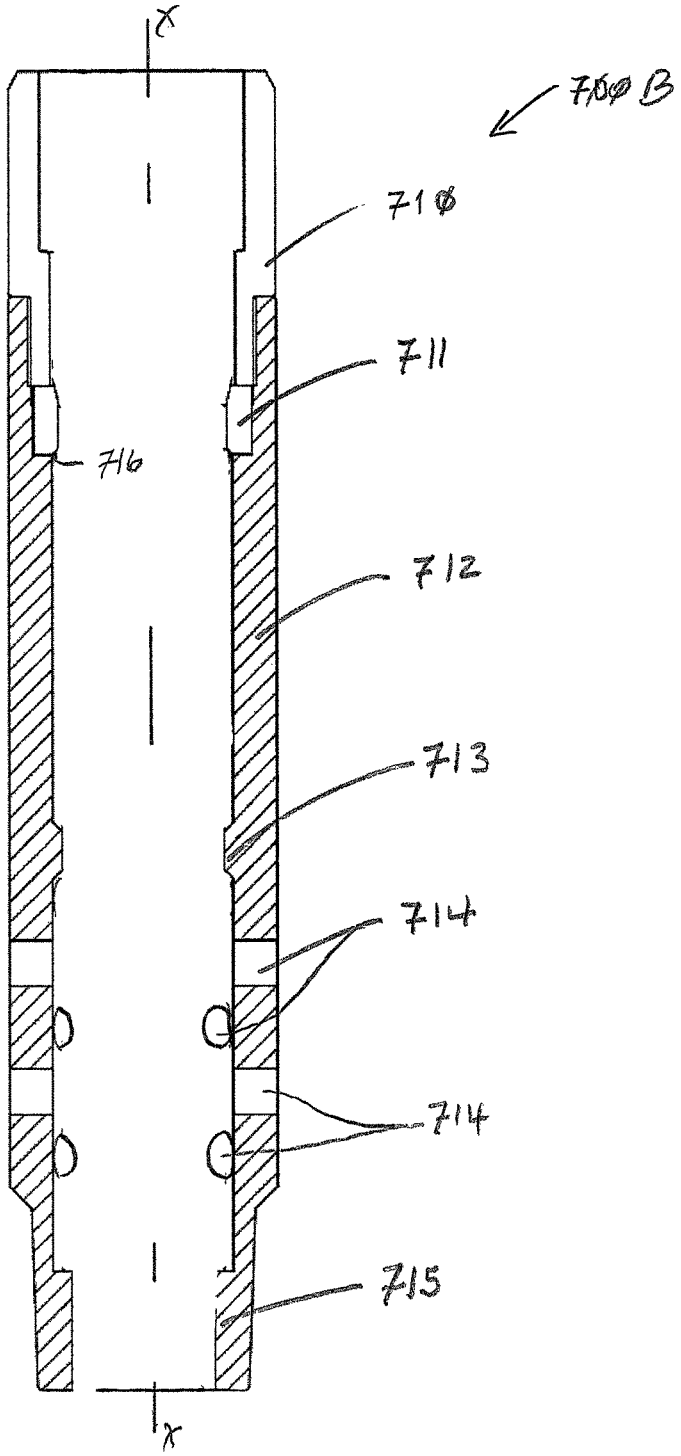
Figure 7C:
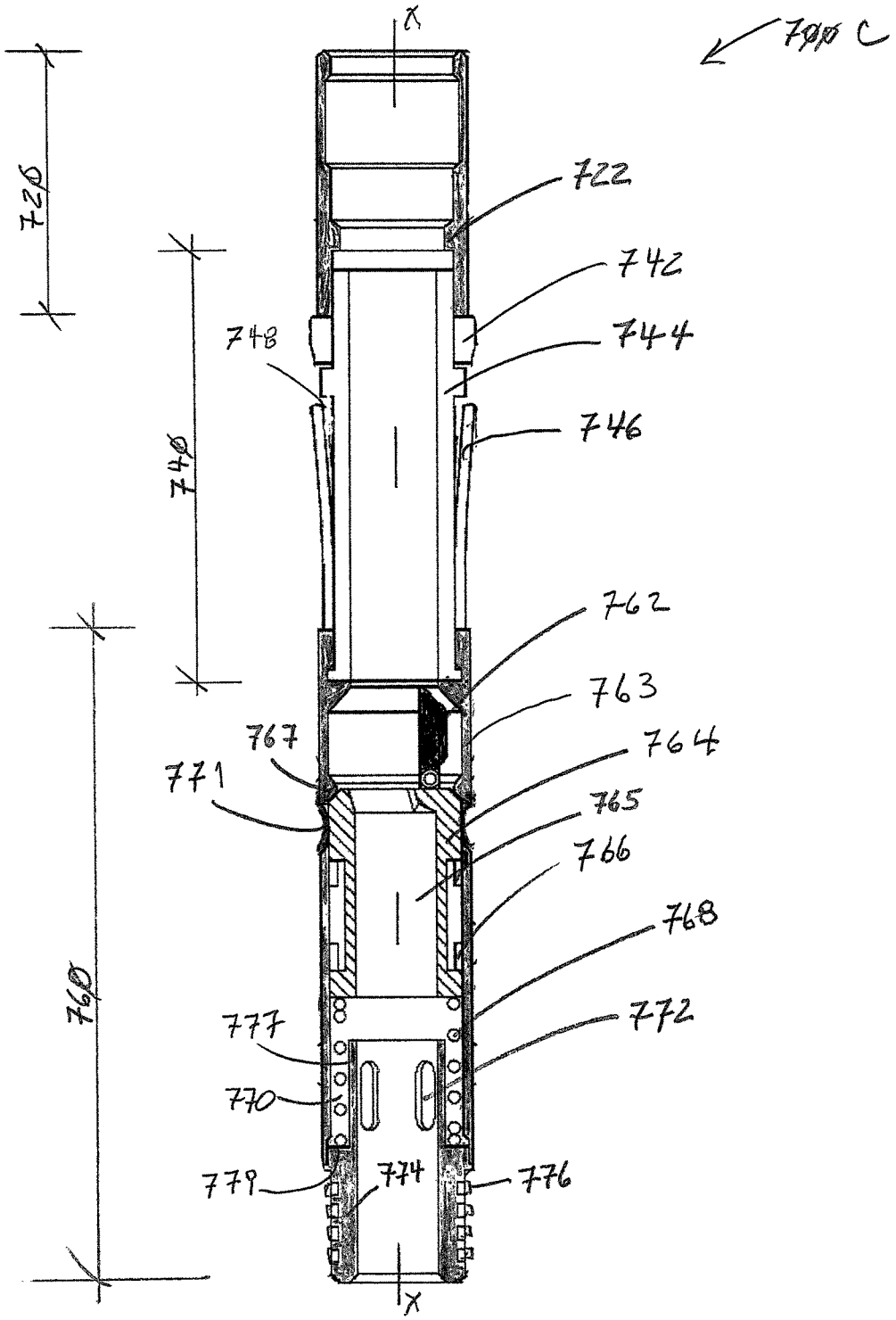

FIGS. 7A-C show a flow router 700A-C. FIG. 7A shows an assembled flow router in a forward flow 701 configuration. FIG. 7B shows a cover assembly 700B. FIG. 7C shows a removable assembly 700C. As shown in FIG. 7A, the flow router 700A includes the removable assembly 700C inserted in the cover assembly 700B.

As seen in FIG. 7B, the cover assembly 700B includes an upper tubing connector 710 that is affixed, for example via a threaded connection, to a cover body 712. When the retrievable assembly 700C is inserted into the cover assembly 700B (as by lowering on a wireline), means for holding the retrievable assembly in place may include a locking part, abutment, or shoulder such as and abutment shoulder 716 formed on a tubing sealing ring 711 located near the upper tubing connector 710.

In some embodiments, retrievable assembly 700C guides are formed by projections 713, 715 directed inwardly from the cover body 712. The projections may be integral with or supported from the cover body.

As shown in FIG. 7C, the retrievable assembly 700C includes a tubular seating mandrel 744 located between and adjoining an upper fishing neck 720 and a lower valve assembly 760. The fishing neck 720 provides an engagement such as an annular internal ring 722 for use with a mating wireline tool for either of retrieving (raising) or installing (lowering) the retrievable assembly 700C via passing it through the tubing string 204. In various embodiments, a retrievable seating ring 742 encircles the mandrel above a mandrel shoulder and abuts the fishing neck.

In addition to providing a flow path between the fishing neck 720 and valve assembly 760, the seating mandrel 740 may include or support peripheral and upwardly directed locking fingers or splines 746 for engaging an internal abutment shoulder of the cover assembly, for example the shoulder 716 of the tubing sealing ring 711. Insertion of the retrievable assembly 700C into the cover assembly 700B initially depresses the fingers which spring out to lock the retrievable assembly in place once they pass the shoulder.

Taper(s) on the finger ends 748 and/or on the shoulder 716 may be used to provide a means for releasing the removable assembly 700C from the cover assembly 700B. In particular, when sufficient force is applied to remove the retrievable assembly 700C from the cover assembly as by a connected wireline (see e.g. FIG. 2), the taper(s) enable finger(s) to slide and move radially inward which releases the finger/shoulder locking mechanism.

The valve assembly 760 includes a valve body 763 with an adjoining lower seating nipple 776. Similar to FIG. 5, within the valve body is a spring 768 biased shuttle 764 with a through hole 765 and an articulated lid 762 for blocking the through hole. An annular chamber 770 between an upstanding nipple wall 777 and the body provides a space for receiving a portion of the spring.

In various embodiments a floor 779 of the annular chamber 770 provides a lower spring support. And, in various embodiments openings 772 in the upstanding nipple wall 777 provide a means for removing and/or flushing contaminants such as sand from the annular chamber that might otherwise hinder spring operation. In some embodiments, sealing rings 766 such as polymeric rings may be carried by the shuttle 764 for sealing between the shuttle and the valve body 763.

Similar to FIG. 5, when the valve is configured for forward flow 701, and the shuttle is in position D1 (see also FIG. 700A). As seen, the lid 762 does not block the shuttle 764 through hole 765, the shuttle is raised such that a spill port 771 is blocked, and the spring 768 is expanded to hold the shuttle against an internal rim stop and/or seal 767 extending from the valve body.

As mentioned above, the cover assembly 700B may include upper 713 and/or lower 715 retrievable assembly 700C guides and/or retrievable assembly to cover assembly annular seals. The upper guides/seals 713 may encircle the valve assembly 760 above a valve spill port 771 and the lower guides/seals 715 may encircle the lower seating nipple 774. In various embodiments one or multiple nipple sealing rings 776 (four shown) such as polymeric sealing rings provide a seal between the nipple and the cover body 712.

In various forward flow embodiments, flows 102 that enter the flow router 700A pass through the valve assembly 760, pass through the seating mandrel 740, and pass through the fishing neck 720 before leaving the removable assembly.

Figure 8:
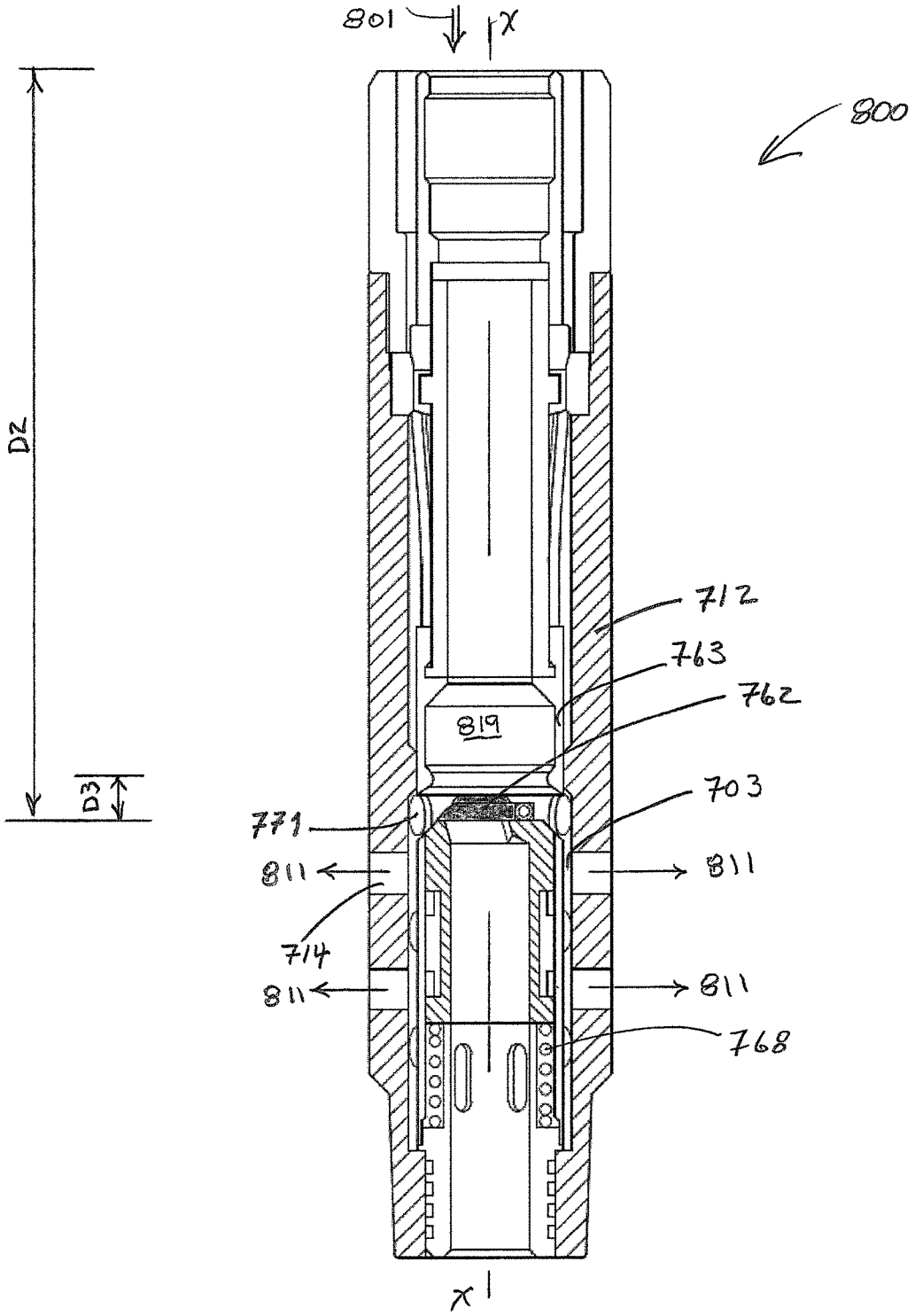

FIG. 8 shows the assembled removable assembly and cover assembly of FIG. 7A in a reverse flow configuration 801.

Similar to FIG. 6, when the valve is configured for reverse flow 801, the lid 762 blocks the shuttle 764 through hole 766, the shuttle is lowered to position D2 (where D2–D1=D3), such that the spill port 771 is open and the shuttle spring 768 is compressed.

Because the shuttle through hole 766 is blocked by the lid 762, reverse flow 801 entering the assembly 800 subsequently leaves the assembly as flows 811 through penetrations 714 in the cover body 712. To the extent the assembly 800 is located within a casing 208, an annular flowpath therebetween may provide for returning spilled fluid to a suction of a pump 104.

In various embodiments, flows 811 leaving the assembly 800 via penetrations 714 in the cover body 712 result from a reverse flow 801 that enters the valve assembly 760, leaves the valve assembly via the valve spill port 771, travels through an annulus 703 between the between the valve body 763 and the cover body 712, and enters the cover penetration (s) 714.

Figure 9A:
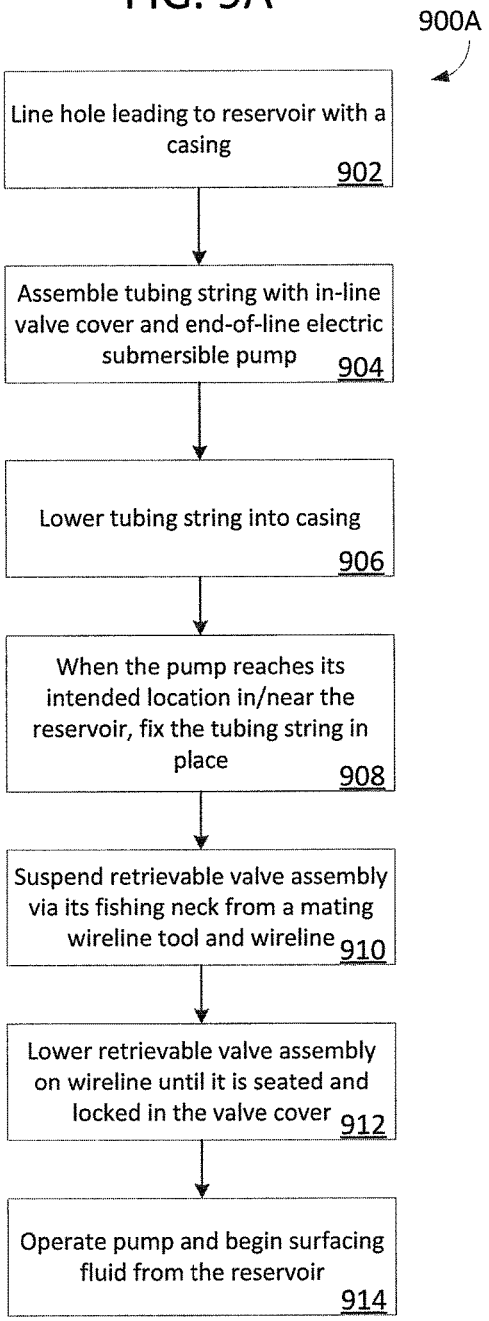
FIGS. 9A-B are charts showing exemplary steps for installation and retrieval of a retrievable assembly of the flow router of FIG. 1.
Figure 9B:
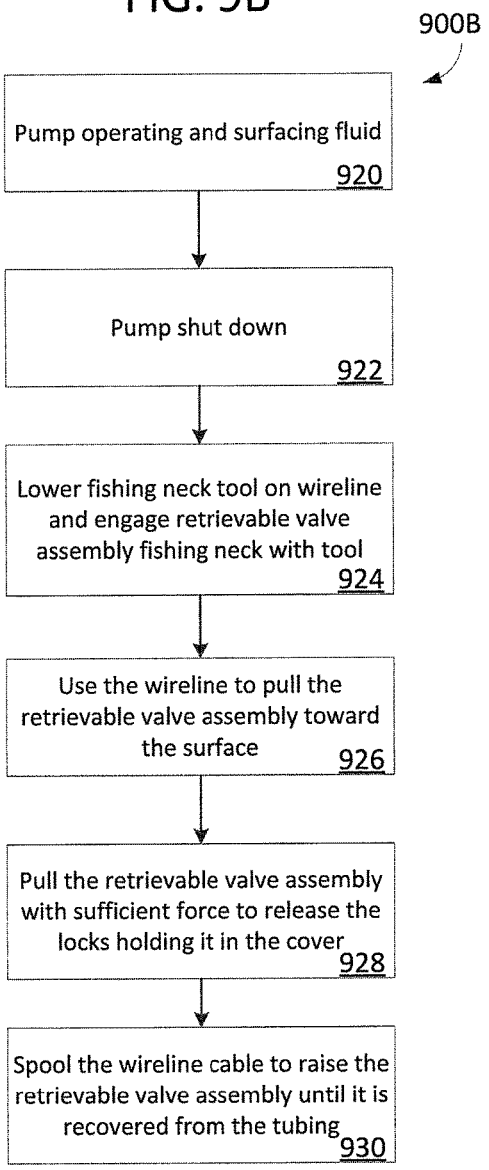

FIGS. 9A-B show examples 900A-B of use of a retrievable assembly such as the ones described above.

FIG. 9A shows a sequence of steps wherein one or more steps may be included in establishing production from a reservoir served by a production string including an in-line cover in a tubing string, the in-line cover for receiving the retrievable assembly.

A well hole leading to a reservoir may be lined with a casing 902. A tubing string e.g. 204 with an in-line perforated cover e.g. 700B and end-of-the-line submersible pump such as an electric pump is assembled 904 and lowered into the casing (e.g. 208) 906. When the pump reaches its intended location in or near the reservoir, the tubing string is fixed in place 908. With the tubing string fixed in place in the casing, a retrievable assembly e.g. 700C is suspended via wireline (see e.g. FIG. 2) and a wireline tool that mates with a fishing neck e.g. 720 of the retrievable valve assembly 910. The retrievable assembly is lowered within the tubing string until it is seated or locked in the valve cover 912. After recovery of the wireline and wireline tool, the production string is otherwise readied as needed with subsequent pump operation and surfacing fluid from the reservoir 914.

FIG. 9B shows a sequence of steps wherein one or more steps may be included in recovering the retrievable assembly 700C, for example a recovery subsequent to a pump 104 shut down.

Here, the pump 104 is initially operating and surfacing fluid 920 before a pump shut down 922. After the pump is shut down, a fishing neck engagement tool is lowered on a wireline (see e.g. FIG. 2) and engages the fishing neck (e.g. 720) 924 of the retrievable assembly 700C. With the tool engaged, the wireline is configured to pull the retrievable assembly to the surface 926. Pulling the retrievable valve with sufficient wireline force, the retrievable valve assembly is lifted as by breaking free locks holding it in the cover (e.g. 700B) 928. Once free, the retrievable valve assembly is recovered from the tubing by lifting and/or spooling up the wireline 930.

It can be appreciated that the above steps 910-914 may also be performed after the steps 924-930 to reinstall the recoverable valve assembly into the in-line valve cover.

In various embodiments, the above described valve cover and retrievable valve assembly may be configured in a production string for use as a pump-off controller.

Figure 10:
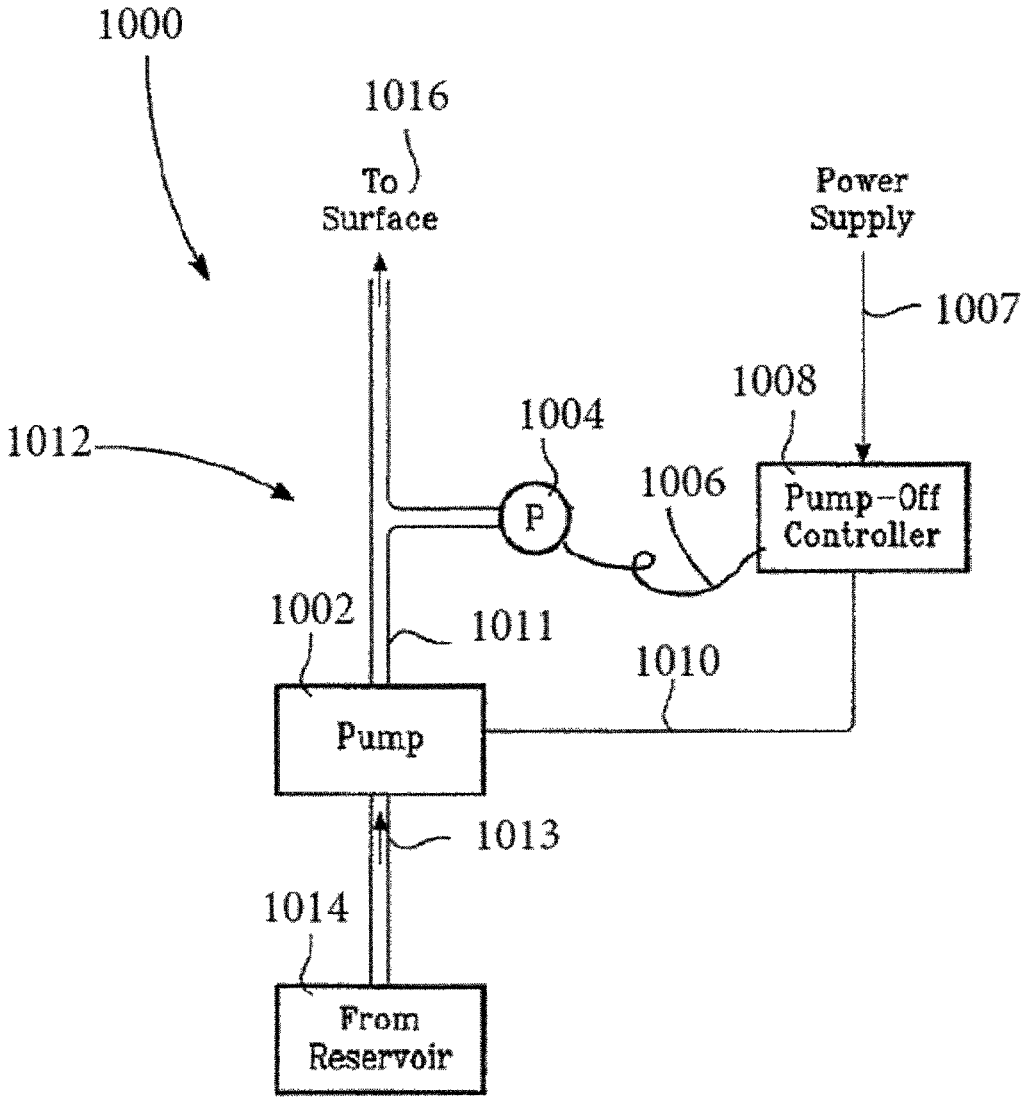
FIGS. 10-12 show pump off controller configurations including configurations that may utilize the flow router of FIG. 1.

FIG. 10 shows an illustrative example in the form of a schematic diagram of a pump-off controller installation in a production string 1000. A portion of the production string 1012 includes a pump 1002 lifting product from a reservoir 1014 to a higher level such as a surface level 1016. A pump-off controller 1008 receives power from a power supply 1007 and provides power to the pump 1010 in accordance with a control algorithm. For example, a pressure indicating device 1004 monitors a pressure near a pump discharge 1011 and provides a signal indicative of pressure 1006 to the pump-off controller. If the pump-off controller determines the indicated pressure is below a preselected low-pressure set point, it stops the supply of electric power to the pump. Conditions causing low pump discharge pressure include insufficient product at the pump inlet 1013 (sometimes described as a "dry suction"), pump fouling, and pump damage. Attempting to run the pump under any of these conditions has the potential to damage or further damage the pump.

Figure 11:
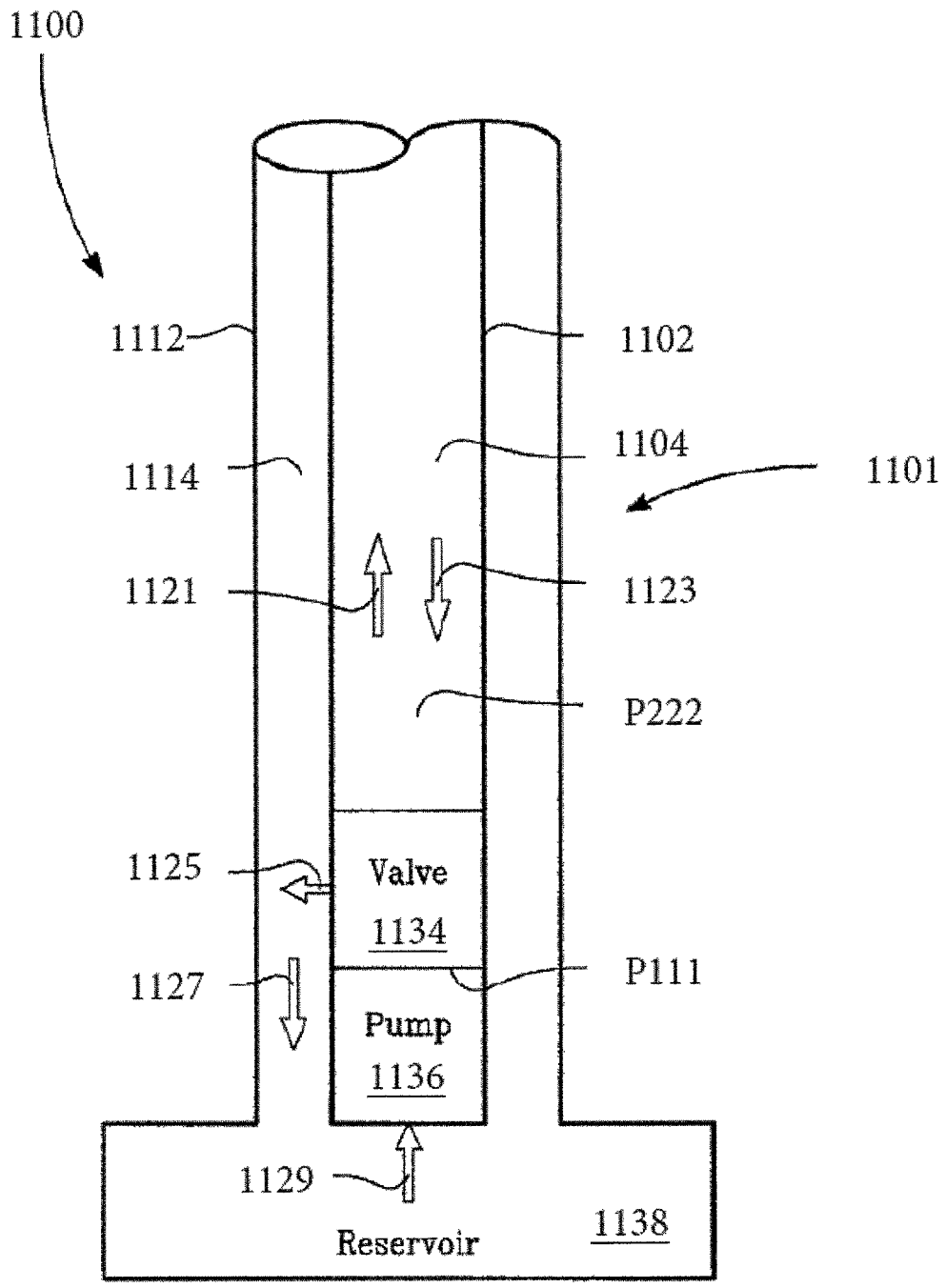

FIG. 11 shows a pump-off controller embodiment of the present invention 1100. A production string 1101 includes a pump 1136 interposed between (i) a valve such as a bypass valve 1134 in a flow router and (ii) a reservoir 1138. Product the pump lifts from the reservoir 1129 passes first through the pump and then through the valve 1134. The valve discharges 1121 into a tubing space 1104 of a tubing string 1102 that is surrounded by a casing 1112 creating an annulus 1114 between the outer casing and the inner tubing 1102.

Figure 12:
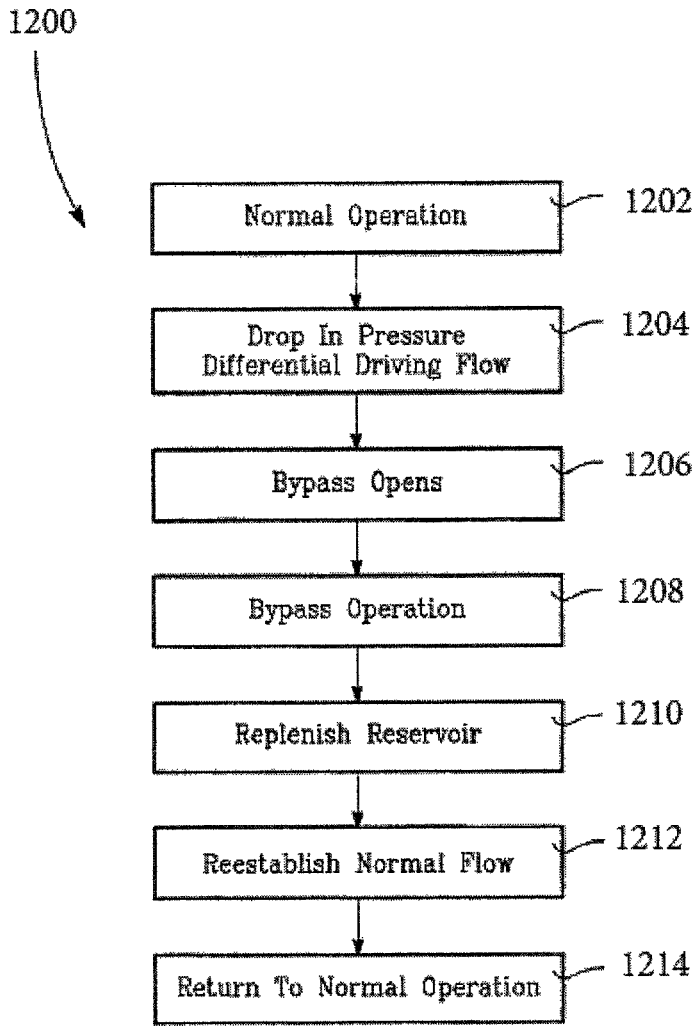

FIG. 12 shows a mode of bypass valve operation that substitutes for or augments a production string pump-off controller 1200. For example, after a period of normal operation 1202, the pressure differential (P111>P222) driving the flow in a production string 1101 begins to fall 1204. As explained above, low flow conditions cause the shuttle articulated lid 762 to close which blocks flow through the valve along its centerline. When the forces on the shuttle including force applied by the shuttle spring 768 are insufficient to maintain the shuttle in a position blocking the spill port 771, the shuttle moves to compress a spring e.g. 768 and unblocks the spill port/opens the bypass 1206. During bypass operation 1208, flow through the valve e.g. 760 along the valve centerline is blocked and the spill port(s) is open, product flows 1123 from the upper tubing string 204, enters a valve outlet chamber 819, and exits the valve 1125 through its spill port(s) 771. The spill port empties into a space such as an annulus between the tubing and the casing 1114 and is returned 1127 to the reservoir 1138 and/or a suction of the pump 1136. Here, the shuttles 520, 664 of FIGS. 5, 7C with articulated lids 531, 762 are exemplary of the shuttles disclosed herein. Further included are shuttles with slotted and/or multipart lids.

Because the annulus 1114 is fluidly coupled to the reservoir 1138 (e.g. as shown in FIG. 8), valve bypass from the spill ports is returned to the reservoir 1127 in the replenishment step 1210. In various embodiments, filling the reservoir with the fluid from the valve bypass serves to provide fluid to the suction of the pump 1136, lift the shuttle e.g., 764, lift the shuttle articulated lid e.g., 762, and unblock flow through the valve along its centerline y-y where forward flow such as normal forward flow is re-established in step 1212. Re-establishment of normal flow is followed by a return to normal operation in step 1214.

The pump-off control steps of FIG. 12 result, in various embodiments, in cyclic flows through a pump such as a continuously operating pump. The time between these cyclic flows may be shorter than would occur with a traditional valve in a traditional production string configuration because such strings are unable to bypass flow to the reservoir.

As persons of ordinary skill in the art will appreciate, many production string pumps rely on the pumped product as pump lubrication and coolant. Therefore, reducing the duration of dry pumping periods reduces pump damage due to operation with insufficient lubricant and/or coolant. The benefits include one or more of longer pump life, fewer outages, and higher production from tight reservoirs.

The present invention is disclosed in the form of exemplary embodiments; however, it should not be limited to these embodiments. Rather, the present invention should be limited only by the claims which follow where the terms of the claims are given the meaning a person of ordinary skill in the art would find them to have.

What is claimed is:

1. A flow router for inclusion in a production string that is for insertion in a well casing, the flow router comprising:
- production tubing;
- a retrievable assembly removably inserted in a perforated cover with a first annular chamber therebetween;
- a valve of the retrievable assembly including a valve body that extends between opposed first and second ends of the valve and defines an axial flowpath;
- a valve body spill port that defines a radial flowpath, the spill port in fluid communication with a second annular chamber located between the well casing and the perforated cover;
- a shuttle inserted in the valve body, the shuttle for selectively blocking the spill port;
- a lid rotatably affixed to a shuttle lid end, the lid for selectively blocking a shuttle through hole;
- the valve for passing an axial flow when (i) the shuttle blocks the spill port and (ii) the lid does not block the through hole; and,
- the valve for blocking an axial flow when (i) the lid blocks the shuttle through hole and (ii) the shuttle does not block the spill port;
- wherein the retrievable assembly is retrievable to and removable from an open end of the production string.

2. The flow router of claim 1 further comprising a spring that biases the shuttle to close the spill port.

3. The flow router of claim 2 wherein the spring is adjacent to an end of the shuttle that is opposite the shuttle lid end.

4. The flow router of claim 1 where a flow handled is a hydrocarbon product from a well in a hydrocarbon reservoir.

5. The flow router of claim 1 including a pump below the valve for lifting a hydrocarbon product.

6. The flow router of claim 1 including a production mode when a pump below the valve lifts a hydrocarbon product through the valve and into the production tubing.

7. The flow router of claim 1 including a backflow mode when hydrostatic pressure of a hydrocarbon product above the valve is sufficient to cause the hydrocarbon product above the valve to move toward the valve, close the lid, and flow through the valve spill port.

8. The flow router of claim 1 is installed with the valve between the production tubing and an end-of-line electric submersible pump.

9. The flow router of claim 8 is installed such that when the pump reaches an intended location with respect to a reservoir, the production tubing is fixed in place.

10. The flow router of claim 9 is installed such that after fixing the production tubing in place, the retrievable assembly is lowered into the production tubing and seated near the pump.

* * * * *